United States Patent [19]

Taira et al.

[11] Patent Number: 4,979,674

[45] Date of Patent: Dec. 25, 1990

[54] FUEL INJECTOR

[75] Inventors: Shigeo Taira; Fumitsugu Yoshizu; Masanori Onishi; Akira Kunishima, all of Higashimatsuyama, Japan

[73] Assignee: Diesel Kiki Co., Ltd., Tokyo, Japan

[21] Appl. No.: 344,668

[22] Filed: Apr. 28, 1989

[30] Foreign Application Priority Data

May 10, 1988 [JP] Japan ..... 63-111566

[51] Int. Cl.[5] ..... F02M 32/02; F02M 47/02

[52] U.S. Cl. ..... 239/90; 239/88; 123/467

[58] Field of Search ..... 239/88, 89, 90, 533.1, 239/533.2, 91, 92, 93, 94; 123/467

[56] References Cited

U.S. PATENT DOCUMENTS

| | | | |
|---|---|---|---|
| 2,551,053 | 5/1951 | Rogers | 239/88 |
| 4,170,974 | 10/1979 | Kopse et al. | 123/467 |
| 4,184,459 | 1/1980 | Ishii et al. | 123/467 |
| 4,271,807 | 6/1981 | Links et al. | 123/467 |
| 4,279,385 | 7/1981 | Straubel et al. | 239/88 |
| 4,378,774 | 4/1983 | Kato | 239/88 |

*Primary Examiner*—Andres Kashnikow
*Assistant Examiner*—Christopher G. Trainor
*Attorney, Agent, or Firm*—Birch, Stewart, Kolasch & Birch

[57] ABSTRACT

A fuel injector includes a pressure chamber and/or a damper chamber to damp the movement of a plunger and a piston after fuel injection has ended. A fuel bypass communicates with the pressure chamber or damper chamber to prevent fuel pressure within the chamber from rising as a consequence of the damping action. The bypass prevents the pressure in the chamber from increasing to the point where the movement of the plunger would be reversed and pressurized fuel would once again be supplied to the nozzle causing secondary injection. The damper chamber and bypass thus serve to prevent bumping between the plunger and the surrounding cylinder and also to prevent secondary injection.

14 Claims, 10 Drawing Sheets

FUEL INJECTOR

BACKGROUND OF THE INVENTION

The present invention relates to a fuel injector for pressurizing fuel supplied to a nozzle by means of oil pressure.

FIG. 1 shows a fuel injector unit in the prior art. When a directional control solenoid valve 70 is at an off state, a pressure chamber 71 is connected via a check valve 72 with an accumulator 73 and a pump 74, and thereby fuel of a tank 75 is supplied to the pressure chamber 71. Also, an upper cylinder 76 is connected with the tank 75, and thereby fuel of the upper cylinder 76 is returned to the tank 75. After fuel has been supplied to the pressure chamber 71, the directional control solenoid valve is changed to an on state. With the on state of the directional control solenoid valve 70, the upper cylinder 76 is connected with the accumulator 73 and the pump 74, and thereby fuel is supplied through the directional control solenoid valve 70 to the upper cylinder 76. By this, a piston 77 and a plunger 78 are pushed down, and fuel of the pressure chamber 71 is pressurized and supplied to a nozzle 79. With a horizontal hole 80 of plunger 78 placed to oppose a groove 82 of a lower cylinder 81, fuel of the pressure chamber 71 is returned through a vertical hole 83, the horizontal hole 80 and the groove 82 to the tank 75, and thereby a fuel injection comes to an end.

According to the aforementioned injector unit, when the horizontal hole 80 of the plunger 78 opposes the groove 82 of the lower cylinder 81, pressure of the pressure chamber 71 drops suddenly. Because of this, the piston 77 and the plunger 78 drop at high speed until the piston stops by bumping against the bottom face of the upper cylinder 76 and the plunger 78 stops by bumping against the bottom face of the pressure chamber 71. As a result, considerable noise and vibration are generated.

SUMMARY OF THE INVENTION

It is an object, therefore, of the present invention to overcome the disadvantages and limitations of prior injector unit by providing a new and improved fuel injector.

Another object of the present invention is to provide a fuel injector which can prevent noise and vibration derived from bumping of the plunger and piston.

Still another object of the present invention is to provide a fuel injector which can prevent secondary injection due to excessively large fuel pressure of the pressure chamber and dumper chamber.

Still another object of the present invention is to provide a fuel injector which car prevent reduction of durability due to unnecessary increase of pressure.

The above and other objects are attained by a fuel injector comprising; an upper cylinder to which oil pressure is supplied; a lower cylinder having a pressure chamber to which fuel is supplied, and located serially with said upper cylinder, a diameter being smaller than a diameter of said upper cylinder; a piston which is provided in said upper cylinder to slide freely, and receives oil pressure supplied to said upper cylinder and move in a pressure direction; a plunger which is provided in said lower cylinder to slide freely, and moved by said piston in the pressure direction, said plunger pressurizing fuel supplied to said pressure chamber with a movement in the pressure direction; injection control means for supplying fuel pressurized by said plunger to a nozzle and for finishing supply of pressurized fuel to said nozzle with said plunger moved to the prescribed position; damper means for functioning fuel of said pressure chamber as a damper for the movement of said plunger in the pressurized direction after said injection control means finishes supply of pressurized fuel to said nozzle; and damper pressure control means for bypassing fuel pressure of said pressure chamber to a low-pressure side so that fuel pressure of said pressure chamber does not increase so much as to move said plunger in the opposite direction from the pressurized direction and supply again the fuel, pressurized exceeding a valve opening pressure of said nozzle, to said nozzle after said injection control means has finished supply of pressurized fuel to said nozzle.

Also, the above and other objects are attained by a fuel injector comprising; an upper cylinder to which oil pressure is supplied; a lower cylinder which provides a pressure chamber to which fuel is supplied, and located serially with said upper cylinder, a diameter being smaller than a diameter of said upper cylinder; a piston which is provided in said upper cylinder to slide freely, and receives oil pressure supplied to said upper cylinder and move in a pressure direction; a plunger which is provided in said lower cylinder to slide freely, and moved by said piston in the pressure direction, said plunger pressurizing fuel supplied to said pressure chamber with a movement in the pressure direction; injection control means for supplying fuel pressurized by said plunger to a nozzle and for finishing supply of pressurized fuel to said nozzle with said plunger moved to the prescribed position; damper means which provides a damper piston, having a smaller diameter than said plunger and provided coaxially at a top end of said plunger, and a damper chamber formed in concave shape in said pressure chamber for receiving said damper piston while allowing free sliding movement of said damper piston, said damper means damping the movement of said plunger in the pressure direction of said plunger by operating fuel pressure of said damper chamber to said damper piston; and damper pressure control means for bypassing fuel pressure of said damper chamber so that fuel pressure of said damper chamber does not become so much as to push said plunger back in the opposite direction from the pressure direction and again supply fuel, pressurized exceeding a valve open pressure of said nozzle, to said nozzle.

BRIEF DESCRIPTION OF THE DRAWINGS

The foregoing and other objects, features and attendant advantages of the present invention will be appreciated as the same become better understood by means of the following description and accompanying drawings wherein.

DETAILED DESCRIPTION OF THE INVENTION

Figure 2:
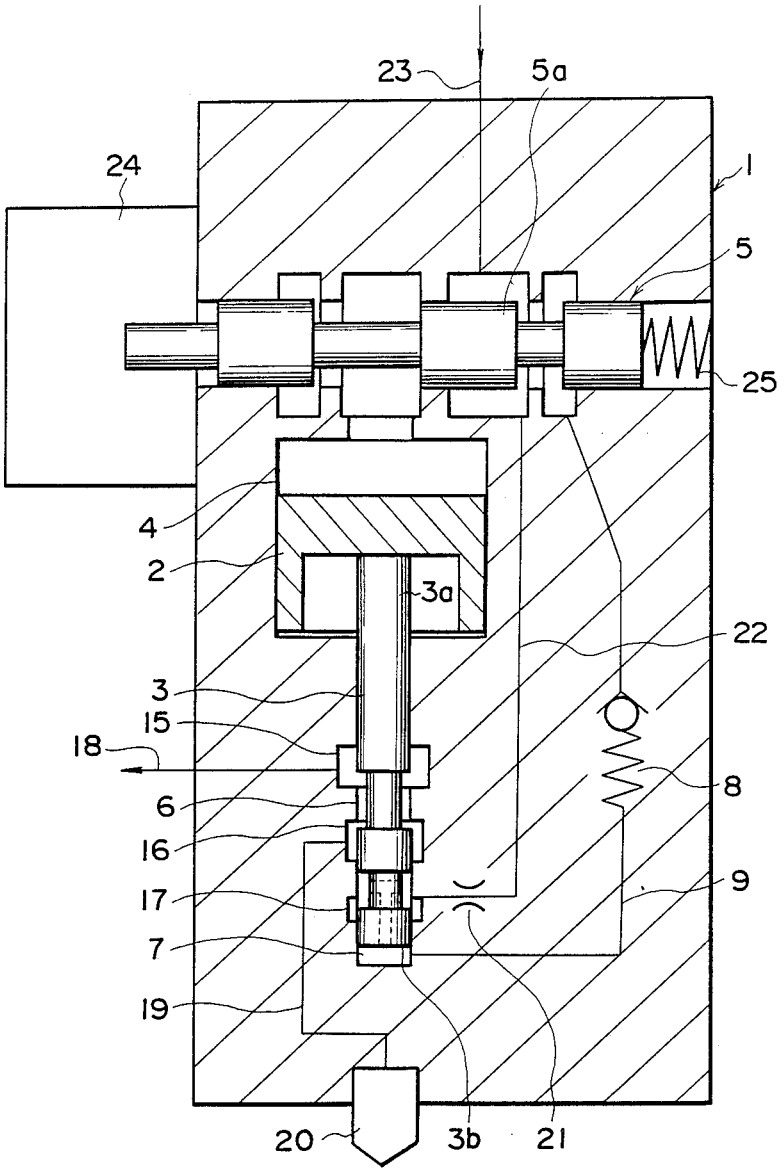
FIG. 2 is a composition drawing showing the first embodiment of the fuel injector according to the present invention.
Figure 3:
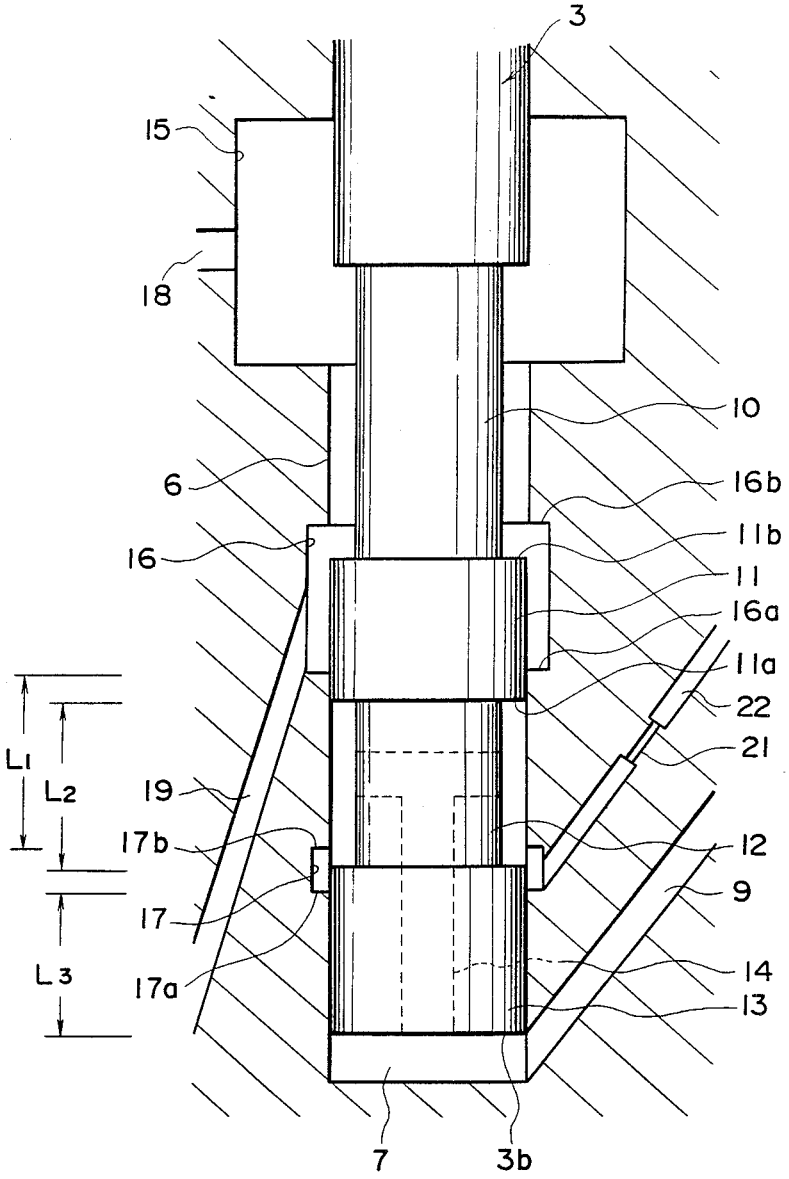
FIG. 3 is a composition drawing showing the principal portions of the first embodiment in FIG. 2.

FIG. 2 and FIG. 3 are composition drawings showing the first embodiment of the present invention, FIG. 2 showing the composition of the whole and FIG. 3 showing the composition of the principal portions.

A reference numeral 1 shows a fuel injector. The fuel injector 1 includes a piston 2 and a plunger 3 with diameter smaller than that of the piston 2. The piston 2 is provided in an upper cylinder 4 to slide freely. A fuel pressure supplied by operation of a spool valve 5 work to the upper end face of the piston 2. The plunger 3 is provided in a lower cylinder 6 with diameter smaller than that of the upper cylinder 4 to slide freely. The lower cylinder 6 is formed coaxially with the upper cylinder 4 and is communicated through the upper cylinder 4. The top end portion 3*a* of the plunger 3 is concerned with the piston 2. The bottom end face 3*b* of the plunger 3 together with the lower cylinder 6 forms a pressure chamber 7. Fuel is supplied through a supply path 9 providing a check valve 8 to the pressure chamber 7. Supply of fuel to the pressure chamber 7 is dependent on operation of the spool valve 5. The plunger 3 moves upwards as fuel is supplied to the pressure chamber 7 to push up the piston 2. By operation of fuel pressure to the pushed up piston 2, the plunger 3 moves in the pressure direction, that is, the plunger 3 lowers. By lowering of the plunger 3, fuel in the pressure chamber 7 is pressurized. The pressure chamber 7 is composed to have a clearance between the bottom end face 3*b* of the plunger 3 and the bottom face of the pressure chamber 7 when the piston 2 lowers to the utmost. Fuel is supplied through the supply path 9 to the clearance of the pressure chamber 7, and thereby fuel pressure operates to the bottom end face 3*b* of the plunger 3.

The plunger 3, as shown in FIG. 3, has a first small-diameter portion 10, a first pressurizing portion 11, a second small-diameter portion 12 and a second pressurizing portion 13, formed in this order in the direction of the bottom end face 3*b*. The bottom end face of the second pressurizing portion 13 forms the bottom end face 3*b* of the plunger 3. For the first and second small-diameter portions 10, 12, diameters of which are both smaller than that of the lower cylinder 6, there are formed clearances, one between the first small-diameter portion 10 and the lower cylinder 6, and the other between the second small-diameter portion 12 and the lower cylinder 6. The first and second pressurizing portions 11 and 13 slide in the lower cylinder while maintaining the closest contact with the lower cylinder 6. The plunger 3 further has a communication path 14. The communication path 14 opens to the bottom end face 3*b* at one end and opens to the side face of the second small-diameter portion 12 at the other end. The lower cylinder 6 provides a cut-off chamber 15, a transfer chamber 16 and a groove 17. The cut-off chamber 15, the transfer chamber 16 and the groove 17 all have diameters larger than that of the plunger 3. The cut-off chamber 15 through a cut-off path 18 is communicated through to a low-pressure portion where the atmospheric pressure operates. The transfer chamber 16 is formed below the cut-off chamber 15, and is connected with a nozzle 20 via a transfer path 19. The groove 17 is formed below the transfer chamber 16, and is connected with the spool valve 5 via a return path 22 which provides an orifice 21.

The clearance between the first small-diameter portion 10 of the plunger 3 and the lower cylinder 6 is composed so that it is communicated with the cut-off chamber 15 of the lower cylinder 6 in spite of the movement of plunger 3. The first pressurizing portion 11 of the plunger 3 at its length in the axial direction is a little shorter than the length of the transfer chamber 16. Because of this, when the plunger 3 slides upward accordingly as fuel is supplied to the pressure chamber 7, first the bottom end 11*a* of the first pressurizing portion 11 becomes above the bottom end 16*a* of the transfer chamber 16, and then the top end 11*b* of the first pressurizing portion 11 becomes above the top end 16*b* of the transfer chamber 16. With the state that the bottom end 11*a* of the first pressurizing portion 11 is above the bottom end 16*a* of the transfer chamber 16, the transfer chamber 16 is communicated through to the pressure chamber 7 via the second small-diameter portion 12 and the communication path 14. With the state that the top end 11*b* of the first pressurizing portion 11 is above the top end 16*b* of the transfer chamber 16, the communication between the transfer chamber 16 and the cut-off chamber 15 is interrupted. When the plunger 3 moves in the pressure direction, all are reversed from the above-stated contents. That is, first the top end 11*b* of the first pressurizing portion 11 becomes below the top end 16*b* of the transfer chamber 16, and then the bottom end 11*a* of the first pressurizing portion 11 becomes below the bottom end 16*a* of the transfer chamber 16. With the state that the top end 11*b* of the first pressurizing portion 11 is below the top end 16*b* of the transfer chamber 16, the transfer chamber 16 is communicated through to the cut-off chamber 15, and a supply of pressurized fuel to the nozzle 20 comes to an end. That is, fuel injection comes to an end. With the state that the bottom end 11*a* of the first pressurizing portion 11 is below the bottom end 16*a* of the transfer chamber 16, the communication between the transfer chamber 16 and the pressure chamber 7 is interrupted. When the communication between the transfer chamber 16 and the pressure chamber 7 is interrupted by lowering of the plunger 3, the pressure chamber 7 becomes a closed state. Because of this, fuel pressure of the pressure chamber 7 operates to the plunger 3. That is, fuel of the pressure chamber 7 functions as a damper against the drop of the plunger 3.

The groove 17 of the lower cylinder 6 is provided so that a distance L1 is equal to or a little larger than a distance L2. The distance L1 is the distance from top end 17*b* of the groove 17 to the bottom end 16*a* of the transfer chamber 16. The distance L2 is the distance between the first pressurizing portion 11 and the second pressurizing portion 13 of the plunger 3, that is, the length of the second small-diameter portion 12 in the axial direction. By this, when the bottom end 11*a* of the first pressurizing portion 11 is below the bottom end 16*a* of the transfer chamber 16 by drop of the plunger 3, the groove 17 is communicated through to the pressure chamber 7 via the second small-diameter portion 12 and the communication path 14. Further, the groove 17 is formed so that the distance L3 from the bottom end 17*a* to the bottom end face 3*b* of the plunger 3 is larger than the amount of movement to the upward of the plunger 3 corresponding to the amount of supplied fuel which gives the maximum amount of injection. By this, the groove 17 is closed by the second pressurizing portion 13 during the time from the start of movement of plunger 3 in the pressure direction to the end of supply of pressurized fuel to the nozzle 20.

Figure 1:
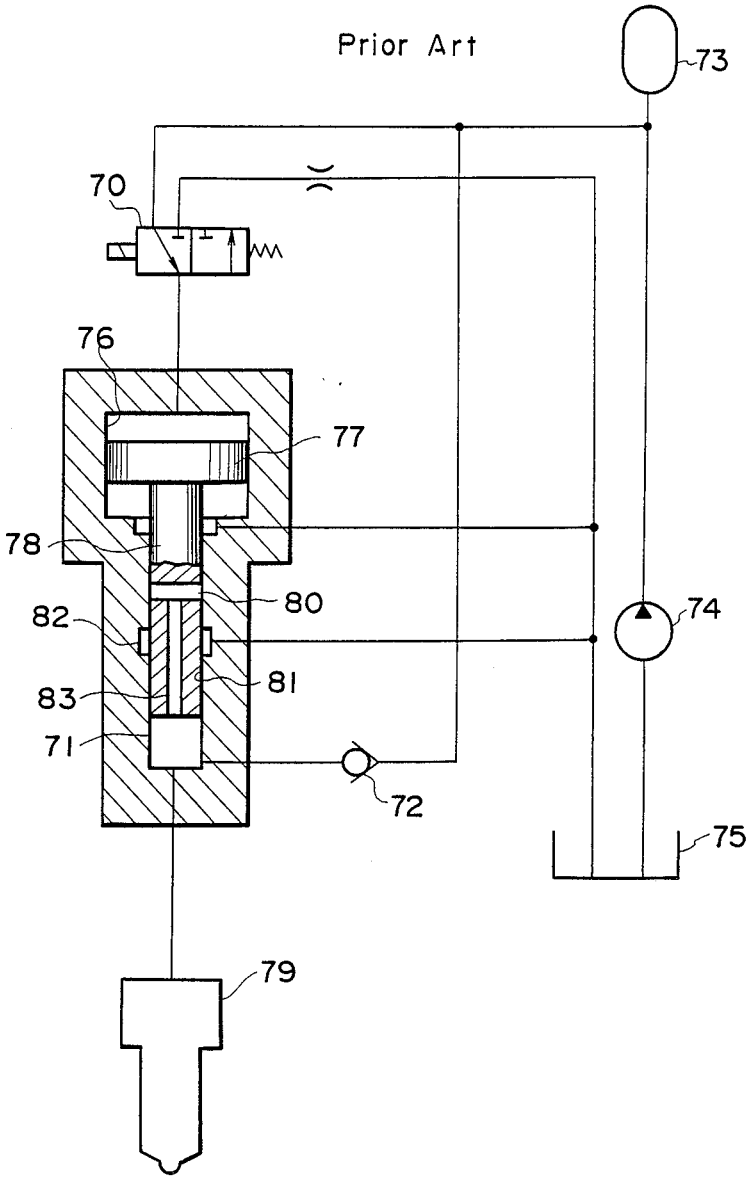
FIG-1 Prior Art
FIG. 1 is a schematic composition drawing showing the prior fuel injector unit.

The spool valve 5 is driven by an electromagnetic actuater 24. When the electromagnetic actuater 24 is at an on state, the spool 5*a* of the spool valve 5 is moved rightward from the state as shown in FIG. 1. By this, the fuel path 23 and the upper cylinder 4 are communicated through, and fuel supplied through the fuel path 23 is supplied to the upper cylinder 4. In this case, the fuel path 23 and the supply path 9 namely the pressure chamber 7 are kept under an intercepted state. On the other hand, when the electromagnetic actuater 24 is at an off state, the spool 5*a* of the spool valve 5 is returned to the state as shown in FIG. 2 by a spring 25. By this, the fuel path 23 and the supply path 9 namely the pressure chamber 7 are communicated through, and fuel is supplied to the pressure chamber 7. In this case, the fuel path 23 and the upper cylinder 4 are kept under an intercepted state. The pressure of fuel supplied through the fuel path 23 is far low as compared with the pressure of pressurized fuel of the pressure chamber 7. The return path 22 is always communicated through to the fuel path 23 irrespective of the movement of the spool 5*a*. By this, the return path 22 is always kept under the low pressure state.

The orifice 21 of the return path 22 has a function for passing fuel pressure of the pressure chamber 7 to the low-pressure side so that the damper effect of the pressure chamber 7 to the drop of the plunger 3 is not spoiled.

Operation of the first embodiment is described in the following.

When fuel is supplied to the pressure chamber 7 by the off state of the electromagnetic actuater 24, the plunger 3 and the piston 2 moves upward, and the communication between the transfer chamber 16 and the cut-off chamber 15 is intercepted by the first pressurizing portion 11 of the plunger 3. By this, the transfer chamber 16 is connected through to the pressure chamber 7 via the second small-diameter portion 12 and the communication path 14, and the groove 17 of the lower cylinder 6 is closed by the second pressurizing portion 13 of the plunger 3. It is added that, though the pressure chamber 7 and the groove 17 are communicated through at the start of supply of fuel to the pressure chamber 7, fuel pressure of the pressure chamber 7 does not go out since a fuel pressure equivalent to the fuel pressure supplied to the pressure chamber 7 operates to the groove 17.

When the prescribed quantity of fuel is supplied to the pressure chamber 7, the electromagnetic actuater 24 is made on. By this, fuel is supplied to the upper cylinder 4, and thereby fuel pressure operates to the piston 2 and the plunger 3 starts moving in the pressure direction. By movement of the plunger 3 in the pressure direction, fuel in the pressure chamber 7 is pressurized, and fuel which is pressurized above the valve opening pressure of the nozzle 20 is supplied through the transfer path 19 to the nozzle 20 to start fuel injection. When the top end 11*b* of the first pressurizing portion 11 of the plunger 3 becomes below the top end 16*b* of the transfer chamber 16, the transfer chamber 16 is communicated through to the cut-off chamber 15, and thereby the fuel pressure of the transfer chamber 16 drops, and supply of pressurized fuel to the nozzle 20 comes to an end. That is, fuel injection comes to an end. Simultaneously with this, the pressure chamber 7 is communicated through to the cut-off chamber 15 for a very short time until the bottom and 11*a* of the first pressurizing portion 11 reaches the bottom end 16*a* of the transfer chamber 16, and fuel pressure of the pressure chamber 7 goes down. It is added that, since the groove 17 is kept closed during the time from the start of the pressurizing movement of the plunger 3 to the end of fuel injection, the pressurized fuel does not go out through the groove 17.

When the bottom end 11*a* of the first pressurizing portion 11 of the plunger 3 reaches the bottom end 16*a* of the transfer chamber 16 of the lower cylinder 6, the communication between the pressure chamber 7 and the transfer chamber 16 is intercepted. By this, the pressure chamber 7 becomes a closed chamber, and fuel of the pressure chamber 7 functions as damper to drop of the plunger 3. Because of this, bumping of the piston 2 against the bottom face of the upper cylinder 4 and bumping of the plunger 3 against the bottom face of the pressure chamber 7 are prevented.

After the bottom end 11*a* of the first pressurizing portion 11 reached the bottom end 16*a* of the transfer chamber 16, the plunger 3 drops by the force of inertia to pressurize the fuel of the pressure chamber 7 more than necessary. In this case, if there is no an escape of the pressurized fuel, the plunger 3 may bound by the fuel pressure of the pressure chamber 7 to result in the top end 11*b* of the first pressurizing portion 11 above the top end 16*b* of the transfer chamber 16. As a result, even when fuel injection has already come to an and, fuel pressurized above the valve open pressure of the nozzle 20 is supplied to the transfer path 19 to generate a secondary injection.

In order to prevent bound of the plunger 3, the groove 17, orifice 21 and the return path 22 are provided. When the bottom end 11*a* of the first pressurizing end 11 of the plunger 3 becomes below the bottom end 16*a* of the transfer chamber 16 of the lower cylinder 6, the pressure chamber 7 is communicated through the communication path 14 and the second small-diameter portion 12 to the groove 17 of the lower cylinder 6. By this, the fuel pressure of the pressure chamber 7 goes off to the low-pressure side through the return path 22 and the orifice 21. That is, the fuel pressure goes off to the fuel path 23. The fuel pressure of the pressure chamber 7 goes off through the orifice 21 so that the fuel does not lose the damper effect to drop of the plunger 3. As a result, the plunger 3 is damped the state that the fuel pressure of the pressure chamber 7 does not become so large as to bound the plunger 3. Therefore, the secondary injection is prevented. Also, unnecessary increase of pressure of the pressure chamber 7 is prevented.

Figure 4:
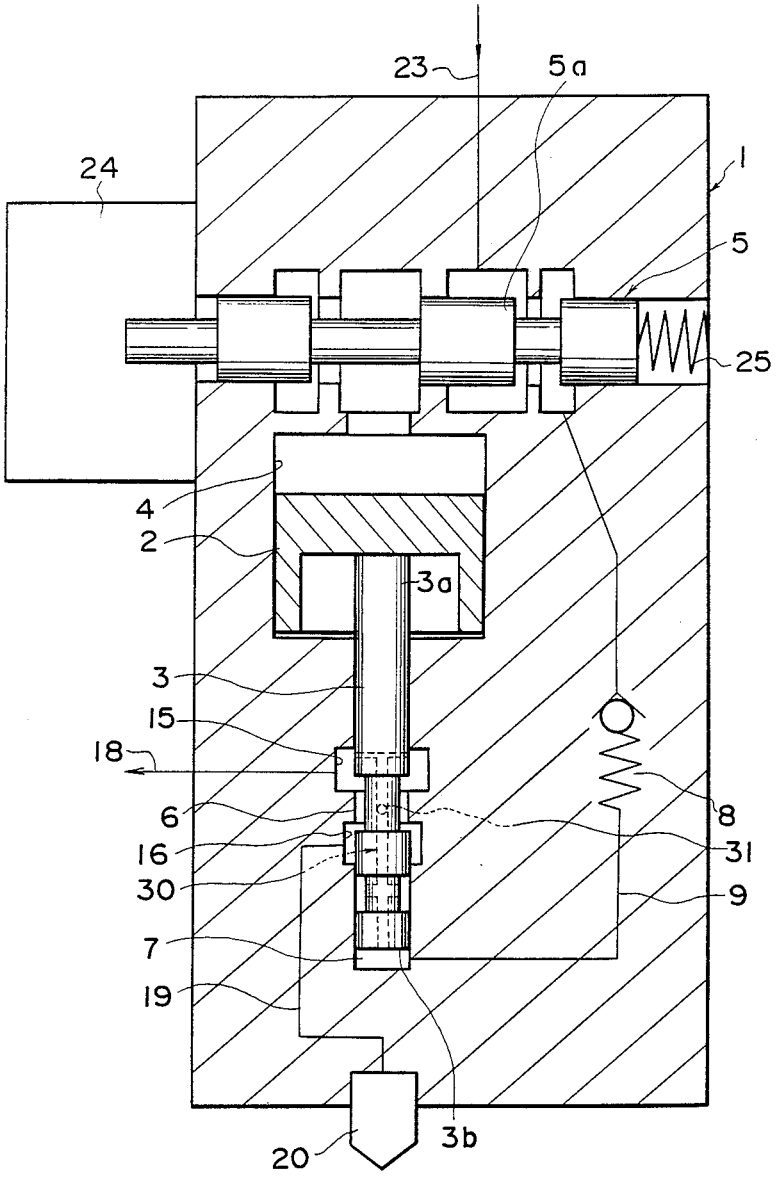
FIG. 4 is a composition drawing showing the second embodiment of the fuel injector according to the present invention.
Figure 5:
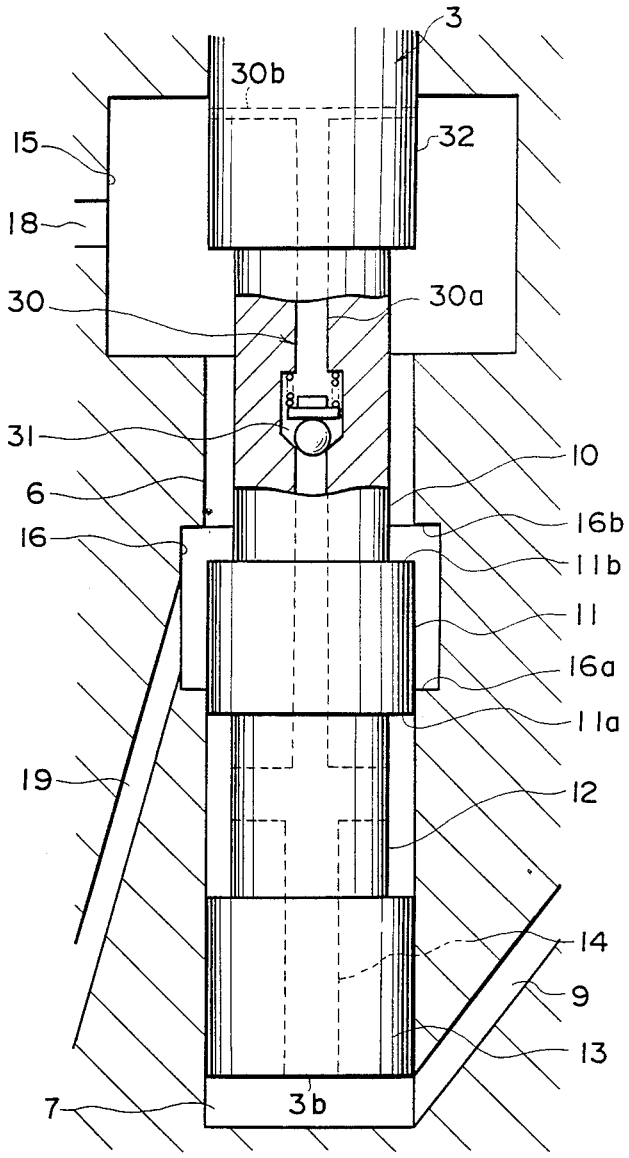
FIG. 5 is a composition drawing showing the principal portions of the second embodiment in FIG. 4.

FIG. 4 and FIG. 5 are composition drawing showing the second embodiment of the present invention, FIG. 4 showing the composition of the whole, and FIG. 5 showing the composition of the principal portions. In FIG. 4 and FIG. 5, portions given the same reference numerals as those of FIG. 2 and FIG. 3 indicate the same portions.

In the second embodiment, instead of the groove 17, the orifice 21 and the return path 22 of the first embodiment, a second communication path 30 is formed in the plunger 3, and a check valve 31 for controlling the damping pressure is provided in the second communication path 30. The second communication path 30 has a vertical hole 30*a* and a control port 30*b* for controlling the damping pressure. The vertical hole 30*a* extends in the axial direction of the plunger 3. The control port 30*b* opens in a side face of a sliding portion 32 positioned above the first small-diameter portion 10 of the plunger 3. The vertical hole 30*a* at its bottom end is connected with the communication path 14, and extends through the first pressurizing portion 11 and the first small-diameter portion 10 of the plunger 3 to the inside of the sliding portion 32 of the plunger 3. The top end of vertical hole 30*a* is communicated through to the control port 30*b*. The control port 30*b* is smaller in diameter than the vertical hole 30*a*, and has an orifice function. The control port 30*b* is formed so that, when the bottom end 11*a* of the first pressurizing portion 11 is above the bottom end 16*a* of the transfer chamber 16, the control port 30*b* is closed by the peripheral wall of the lower cylinder 6, and so that the control port 30*b* is communicated with the cut-off chamber 15 when the bottom end 11*a* of the first pressurizing portion 11 is below the bottom end 16*a* of the transfer chamber 16. The check valve 31 for controlling the damping pressure is provided at the vertical hole 30*a* of the second communication path 30 so that the direction from the pressure chamber 7 to the control port 30*b* is the forward direction. The check valve 31 of the open valve pressure is higher than the supplying pressure of the fuel supplied through the supply path 9 to the pressure chamber 7. Moreover, the check valve 31 is composed so as to open before the fuel pressure of the pressure chamber 7 becomes so large as to push up the plunger 3 to supply the fuel pressurized above the open valve pressure of the nozzle 20 to the transfer path 19 after finishing an injection of fuel. Composition of other portions is as described in relation to FIG. 2 and FIG. 3.

Operation of the second embodiment is described in the following.

When the top end 11*b* of the first pressurizing portion 11 becomes below the top end 16*b* of the transfer chamber 16 by movement of the plunger 3 in the pressure direction, a fuel injection comes to an end. Following this, the bottom end 11*a* of the first pressurizing portion 11 also becomes below the bottom end 16*a* of the transfer chamber 16, and the control port 30*b* is communicated through to the cut-off chamber 15. The check valve 31 for controlling the damping pressure opens before the fuel pressure of the pressure chamber 7 becomes so much as to push up the plunger 3 and supply fuel pressurized above the valve opening pressure of the nozzle 20 to the transfer path 19. By this, the fuel pressure of the pressure chamber 7 is bypassed through the check valve 31 and the control port 30*b* to the cut-off chamber 15. The fuel pressure of the pressure chamber 7 is bypassed by the area of passage of the check valve 31 and the control port 30*b*, which has an orifice function, so that the damper effect against drop of the plunger 3 is not spoiled. As a result, like the case of the first embodiment, the plunger 3 is damped under the state that the fuel pressure of the pressure chamber 7 does not become so much as to bound the plunger 3. Consequently, a secondary injection is prevented. It is added that, since the control port 30*b* is kept opened by the peripheral wall of the lower cylinder 6, the check valve 31, if opened during pressurization of fuel by the plunger 3, would not hinder the pressurization of fuel. Also, since the check valve 31 has the open valve pressure higher than the fuel pressure supplied to the pressure chamber 7, the fuel pressure of the pressure chamber 7 does not go out during supply of fuel to the pressure chamber 7.

Figure 6:
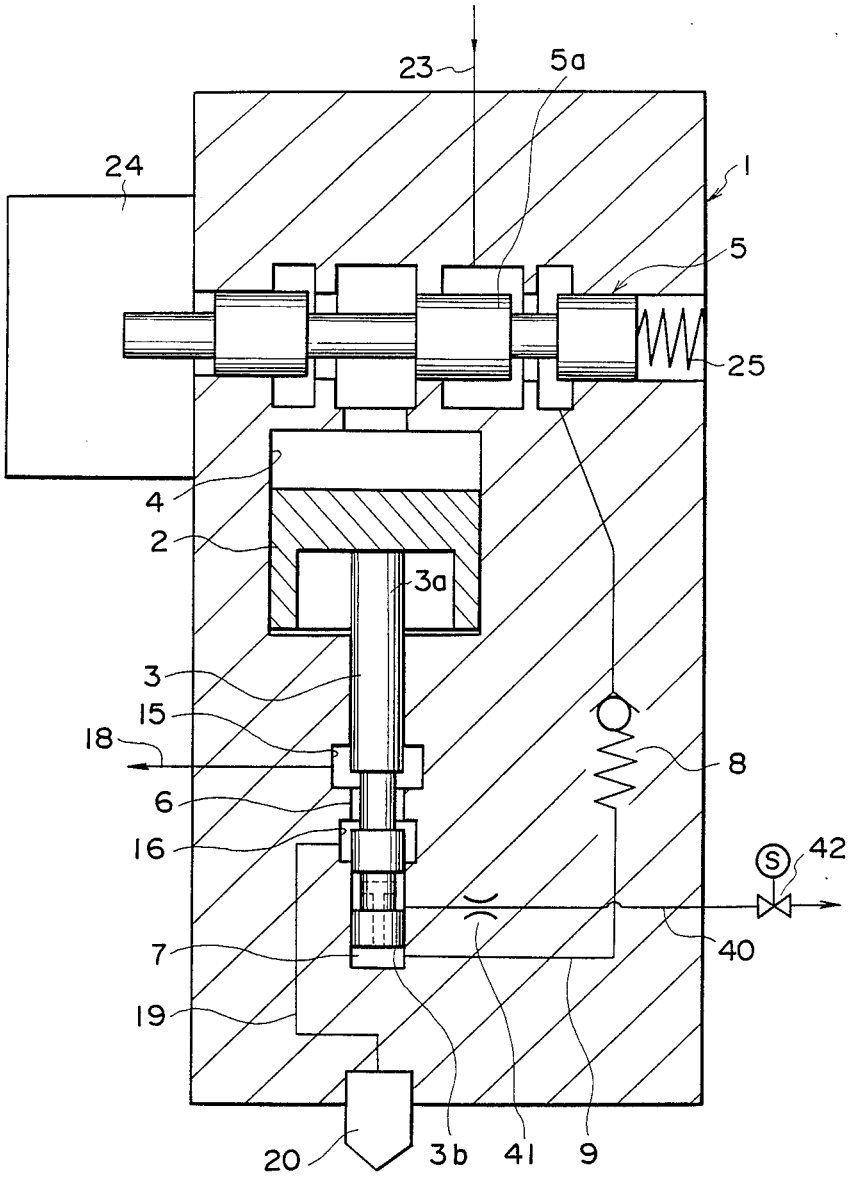
FIG. 6 is a composition drawing of the third embodiment of the fuel injector according to the present invention.
Figure 7:
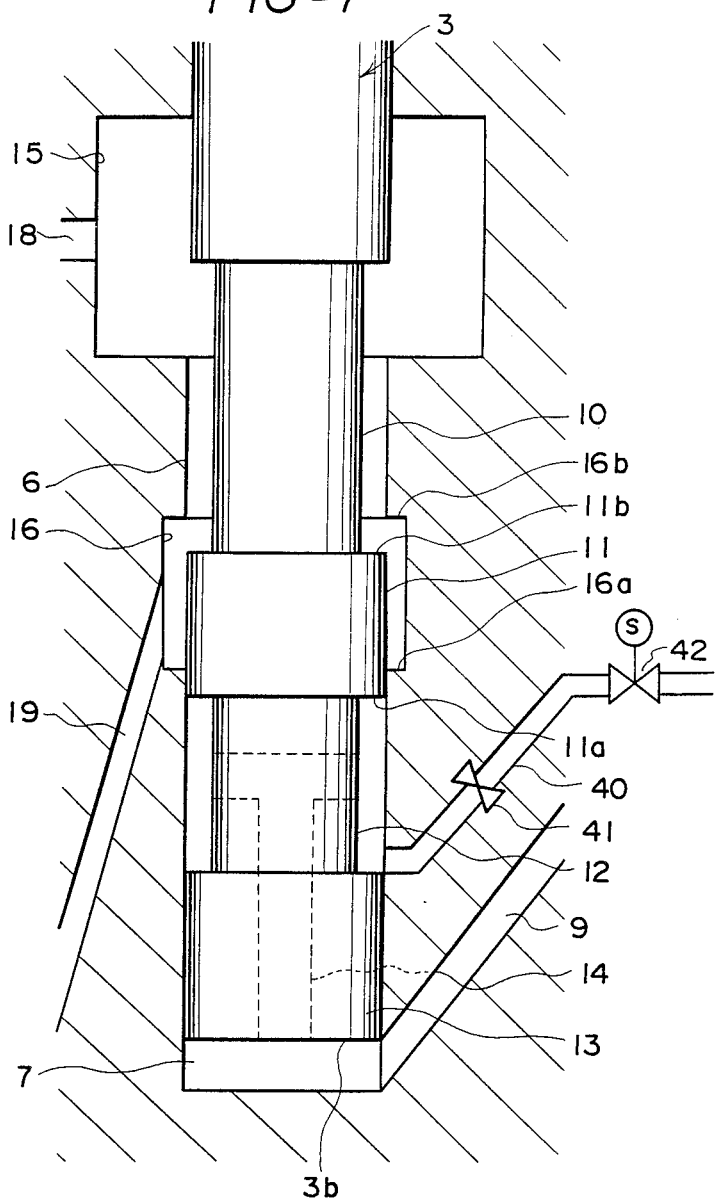
FIG. 7 is a composition drawing showing the principal portions of the third embodiment in FIG. 6.

FIG. 6 and FIG. 7 are composition drawings showing the third embodiment of the present invention, FIG. 6 showing the composition of the whole, and FIG. 7 showing the composition of principal portions. In FIG. 6 and FIG. 7, portions given the same reference numerals as those of FIG. 2 and FIG. 3 indicate the same portions.

In the third embodiment, instead of the groove 17, the orifice 21 and the return path 22 of the first embodiment, a by-path 40, an orifice 41 and an electromagnetic valve 42 are provided. The by-path 40 at its one end is opened to the lower cylinder 6, and at its other end is communicated through to a low-pressure side where the atmospheric pressure operates. The by-path 40, when the bottom end 11*a* of the first pressurizing portion 11 of the plunger 3 becomes below the bottom end 16*a* of the transfer chamber 16, is communicated through the second small-diameter portion 12 and the communication path 14 to the pressure chamber 7. The orifice 41 and the electromagnetic valve 42 are provided in the by-path 40. The orifice 41 has the same function as that of the orifice 21 of the first embodiment. The orifice 41 passes the fuel pressure of the pressure chamber 7 so that the damper effect of the pressure chamber 7 against drop of the plunger 3 is not spoiled. The electromagnetic valve 42 is controlled to close the by-path 40 when the electromagnetic actuater 24 is off (that is, during supply of fuel to the pressure chamber 7), and to open the by-path 40 when the electromagnetic actuater 24 is on (that is, during drop of the plunger 3). Composition of other portions is as described in FIG. 2 and FIG. 3.

Operation of the third embodiment is described in the following.

When the electromagnetic actuater 24 is made on, fuel pressure operates to the piston 2, and the plunger 3 starts moving in the pressure direction. Simultaneously with this, the electromagnetic valve 42 opens the by-path 40. When the movement of the plunger 3 in the pressure direction proceed and the top end 11*b* of the first pressurizing portion 11 becomes below the top end 16*b* of the transfer chamber 16, supply of pressurized fuel to the nozzle 20 comes to an end. That is, a fuel injection comes to an end. Following this, the bottom end 11*a* of the first pressurizing portion 11 becomes below the bottom end 16*a* of the transfer chamber 16, and the by-path 40 is communicated through to the pressure chamber 7. Since the by-path 40 is opened by the electromagnetic valve 42, the fuel pressure of the pressure chamber 7 is bypassed to the low-pressure portion, where the atmospheric pressure operates, through the orifice 41. The fuel pressure of the pressure chamber 7 is passed by the orifice 41 so that the damper effect against drop of the plunger 3 is not spoiled. As a result, the plunger 3 is damped under the state that the fuel pressure of the pressure chamber 7 does not become so much as to push up the plunger 3. Consequently, a secondary injection as well as unnecessary increase of pressure is prevented. It is added that, since the electromagnetic valve 42 closes the by-path 40 during supply of fuel to the pressure chamber 7, the fuel pressure does not go out during supply of fuel to the pressure chamber 7.

Figure 8:
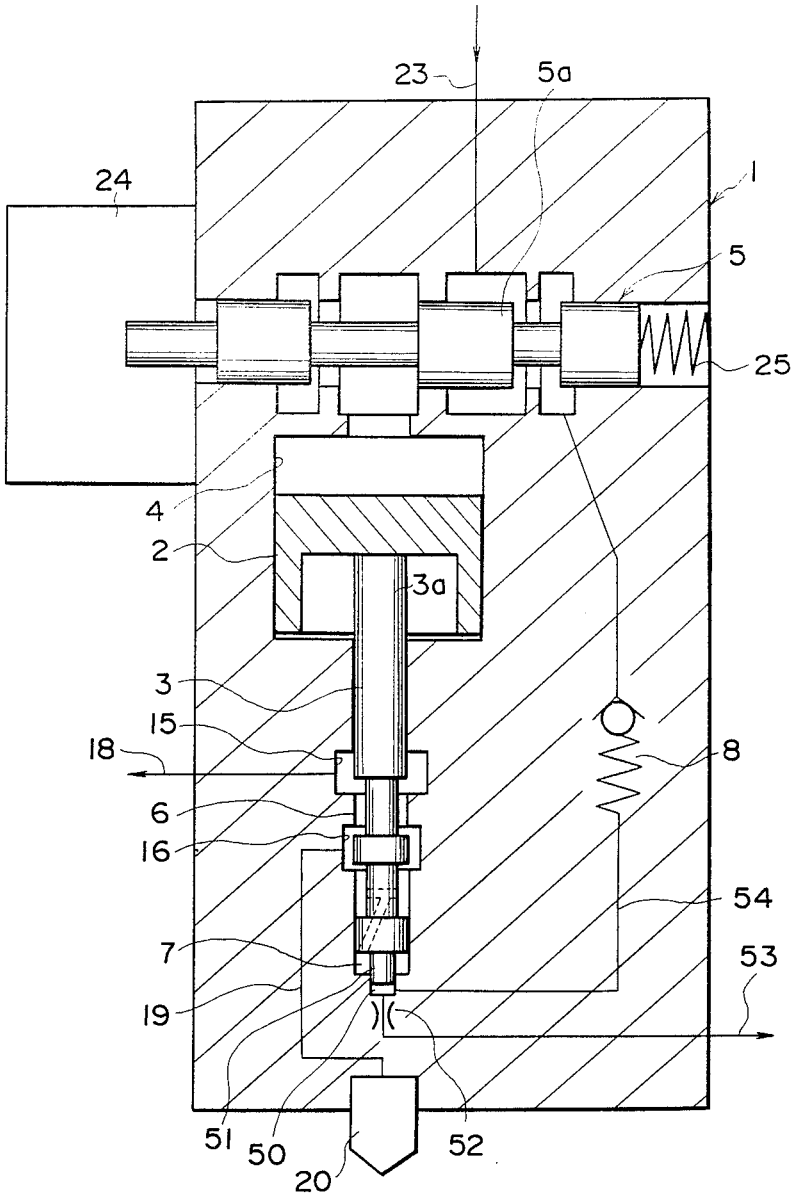
FIG. 8 is a composition drawing showing the fourth embodiment of the fuel injector according to the present injection.
Figure 9:
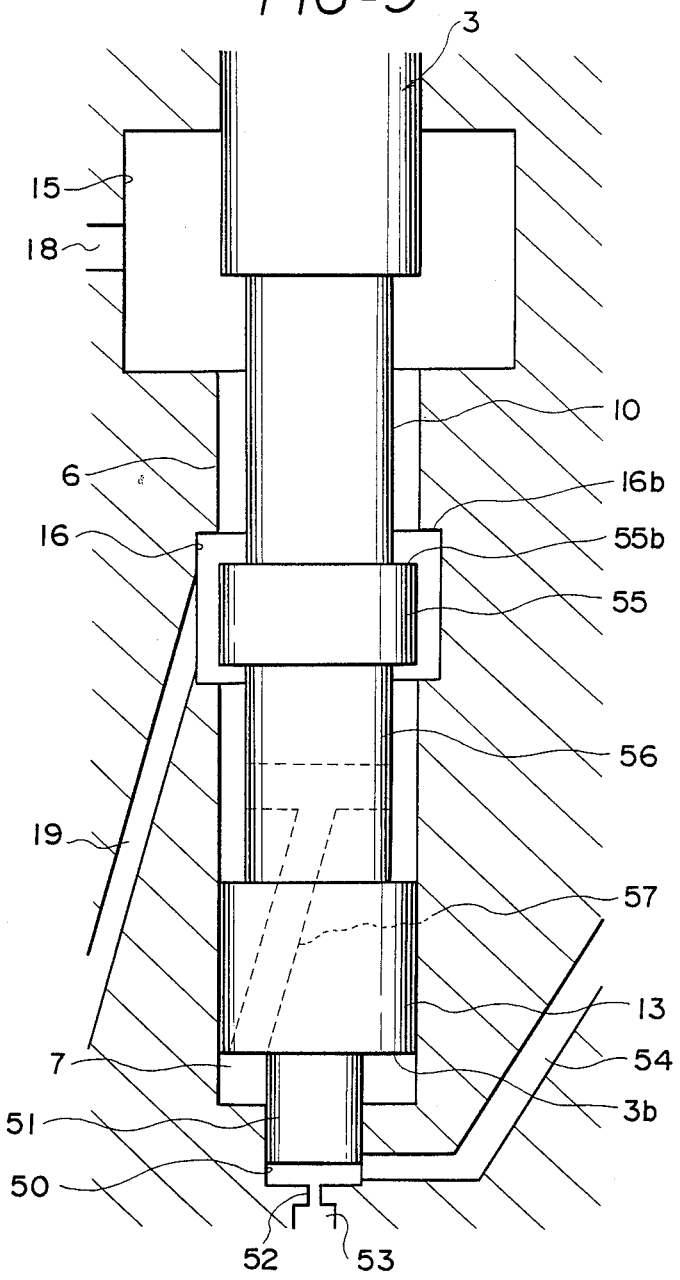
FIG. 9 is a composition drawing showing the principal portions of the fourth embodiment in FIG. 8.

FIG. 8 and FIG. 9 are composition drawings showing the fourth embodiment of the present invention, FIG. 8 showing the composition of the whole, and FIG. 9 showing the composition of the principal portions. In FIG. 8 and FIG. 9, portions given the same reference numerals as those of FIG. 2 and FIG. 3 indicate the same portions.

In the fourth embodiment, instead of the groove 17, orifice 21 and return path 22 of the first embodiment, a damper chamber 50, a damper piston 51, an orifice 52 and a return path 53 are provided. Moreover, in the fourth embodiment, the supply path 9, first pressurizing portion 11, second small-diameter portion 12 and communication path 14 of the first embodiment are respectively changed to a supply path 54, a first pressurizing portion 55, a second small-diameter portion 56 and a communication path 57. The damper chamber 50 is formed in the concave shape on the bottom face of the pressure chamber 7. The damper chamber is smaller in diameter than the pressure chamber 7, and receiving a damper piston 51 to slide freely. The damper piston 51 is smaller in diameter than the plunger 3, and projects from the bottom end face **3*b* of the plunger 3 extending in the downward axial direction. The damper piston 51 is unified with the plunger 3. The supply path 54 supplies fuel to the damper chamber 50. Fuel is supplied through the damper chamber 50 to the pressure chamber 7. The other end of the supply path 54, like the supply path 9 of the first embodiment, is connected via the check valve 8 to the spool valve 5. The return path 53 at its one end is communicated through the orifice 52 to the bottom face of the damper chamber 50, and at its other end is communicated through to the low-pressure side which receives the atmospheric pressure. The orifice 52 passes the fuel pressure of the damper chamber 50 so that the plunger 3 can move upward by fuel pressure when fuel is supplied to the damper chamber 50, and, so that the damper effect against drop of the piston, namely drop of the plunger 3 is not spoiled. The damper piston 51 enters in the damper chamber 50 before supply of pressurized fuel comes to an end so that fuel pressure does not go out through the orifice 52 when the plunger 3 moves in the pressure direction. By this, the orifice 52 is closed. The first pressurizing portion 55 of the plunger 3 is shorter in length in the axial direction than the first pressurizing portion 11 of the first embodiment, and the second small-diameter portion 56 is longer in the axial direction than the second small-diameter portion 12 of the first embodiment. By this, the communication between the pressure chamber 7 and the cut-off chamber 15 is maintained when a fuel injection comes to an end by the state that the top end 55*b* of the first pressurizing portion 55 becomes below the top end 16*b* of the transfer chamber 16. The communication path 57 of the plunger 3 has a vertival hole formed diagonally against the axial direction of the plunger 3 so that the communication path 57 communicates through to the pressure chamber 7 avoiding the damper piston 51. Compostion of other portions is as described in FIG. 2 and FIG. 3**.

Operation of the fourth embodiment is described in the following.

When the top end **55*b* of the first pressurizing portion 55 becomes below the top end 16*b* of the transfer chamber 16 by movement of the plunger 3 in the pressure direction, a fuel injection comes to an end. When the fuel injection comes to an end, fuel of the damper chamber 50 is pressurized by the damper piston 51 under the state that communication between the pressure chamber 7 and the cut-off chamber 15 is maintained by the communication path 57, the second small-diameter portion 56, the transfer chamber 16 and the first small-diameter chamber 10. The fuel pressure of the damper chamber 50 is bypassed to the low-pressure side, where the atmospheric pressure operates, through the orifice 52 so that the damper effect against drop of the plunger 3 is not spoiled. And yet, since the diameter of the damper piston 51 is smaller than that of the plunger 3, the pressure receiving area is smaller compared with the case in which fuel pressure is received by the bottom end 3*b* of the plunger 3. As a result, the plunger 3 is damped under the state that the fuel pressure of the damper chamber 50 does not become so much as to push up the damper piston 51, namely the plunger 3. Therefore, a secondary injection and unnecessary increase of pressure are prevented. It is added that, since the damper piston 51 slides out of the damper chamber 50 after the top end 55*b* of the first pressurizing portion 55 has become above the top end 16*b* of the transfer chamber 16 and fuel enters the pressure chamber 7** during supply of fuel to the pressure chamber, no hindrance occurs against supply of fuel.

Although the fuel pressure of the damper chamber 50 is bypassed to the low-pressure side where the atmospheric pressure operates in the fourth embodiment, the fuel pressure may be bypassed to the low-pressure side where the pressure of supplied fuel operates as the first embodiment.

Figure 10:
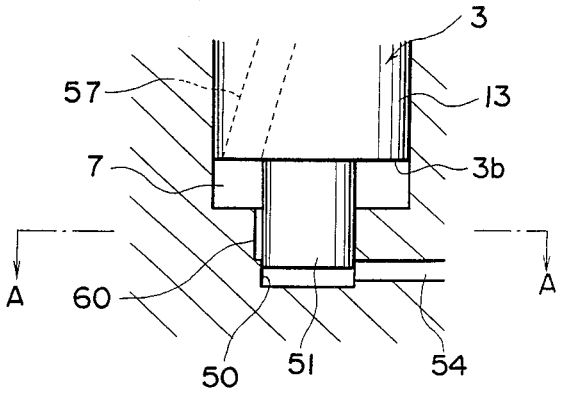
FIG. 10 is a composition drawing of the fifth embodiment of the fuel injector according to the present invention.
Figure 11:
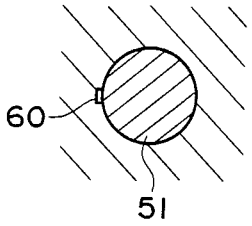
FIG. 11 is the A—A section drawing of FIG. 10.

FIG. 10 and FIG. 11 are composition drawings showing the principal portions of the fifth embodiment of the present invention, FIG. 11 showing an A—A section of FIG. 10. In these figures, portions having the same reference numerals as those of FIG. 8 and FIG. 9 indicate the same portions.

In the fifth embodiment, instead of the orifice 52 and the return path 53 of the fourth embodiment, a slit 60 for communicating the damper chamber 50 and the pressure chamber 7. The slit 60 is formed in the peripheral wall of the damper chamber 50, and its top end is opened in the bottom face of the pressure chamber 7. The slit 60 bypasses the fuel pressure of the damper chamber 50 so that the plunger 3 can move upwards by fuel pressure when fuel is supplied to the damper chamber 50, and so that the damper effect of the damper chamber 50 against drop of damper piston 51, namely the plunger 3 is not spoiled. Since the pressure chamber 7 and the cut-off chamber 15 are communicated through in a process in which the plunger 3 is damped by the fuel pressure of the damper chamber 50, the same effect as that of the fourth embodiment can be obtained by bypassing the fuel pressure of the damper chamber 50 to the pressure chamber 7. Composition and operation of other portions are as described in the fourth embodiment.

As described above in detail, according to the fuel injector of the present invention, the plunger is damped by fuel of the pressure chamber or of the damper chamber, and, the fuel pressure of the pressure chamber or of the damper chamber is bypassed to the low-pressure portion so that the fuel pressure does not become so much as to bound the plunger and supply fuel, pressurized above the valve opening pressure of the nozzle, to the nozzle. Because of this, bumping of the piston to the bottom face of the upper cylinder and bumping of the plunger to the bottom face of the pressure chamber are prevented. Therefore, bumping noise and vibration can be prevented. Also, since bound of the plunger due to increase of the pressure of the pressure chamber or of the damper chamber is prevented, a secondary injection can be prevented, and unnecessary increase of the pressure of the pressure chamber or of the damper chamber can be prevented at the same time.

From the foregoing it will now be apparent that a new and improved fuel injector has been found. It should be understood of course that the embodiment is merely illustrative and is not intended to limit the scope of the invention. Reference should be made to the appended claims, therefore, rather than the specification, to determine the scope of the invention.

What is claimed is:

1. A fuel injector comprising:

an upper cylinder to which oil pressure is supplied;

a lower cylinder having a pressure chamber to which fuel is supplied, and located serially with said upper cylinder, a diameter being smaller than a diameter of said upper cylinder;

a piston which is provided in said upper cylinder to slide freely, and move in a direction as to pressurize fuel supplied to said pressure chamber by receiving oil pressure supplied to said upper cylinder;

a plunger which is provided in said lower cylinder to slide freely, and is moved in said direction by said piston, said plunger pressurizing fuel supplied to said pressure chamber with a movement in said direction;

injection control means for supplying fuel pressurized by said plunger to a nozzle and for finishing supply of pressurized fuel to said nozzle with said plunger moved to a prescribed position, said injection control means having a cut-off chamber which is formed in said lower cylinder and communicated through to a low-pressure portion where atmospheric pressure operates, a transfer chamber which is formed in said lower cylinder and communicated through to said nozzle, a first small-diameter portion which is formed in said plunger and gives a first clearance between said plunger and said lower cylinder, said first clearance being communicated through to said cut-off chamber, a first pressurizing portion formed in said plunger, a second small-diameter portion which is formed in said plunger and gives a second clearance between said plunger and said lower cylinder, said second clearance being communicated through to said pressure chamber, said first pressurizing portion maintaining communication between said transfer chamber and said pressure chamber via said second clearance after said plunger starts movement in said direction until said plunger reaches said prescribed position, and said first pressurizing portion, when said plunger moves to said prescribed position, communicating said transfer chamber through to said cut-off chamber via said first clearance;

damper means for closing said pressure chamber by intercept communication between said transfer chamber and said second clearance by said first pressurizing portion after said injection control means finishes supply of pressurized fuel to said nozzle, said damper means operating fuel pressure of said pressure chamber to said second clearance and a second pressurizing portion which is formed at the top end portion of said plunger; and damper pressure control means for bypassing fuel pressure of said pressure chamber to a low-pressure side so that fuel pressure of said pressure chamber does not increase so much as to cause secondary fuel injection after said injection control means has finished supply of pressurized fuel to said nozzle.

2. A fuel injector according to claim 1, wherein said damper pressure control means comprise:

a groove which is formed in said lower cylinder and communicated through to said pressure chamber after said plunger moves to said prescribed position;

said groove being formed between said transfer chamber of said lower cylinder and said pressure chamber so that a distance L1 between said groove and said transfer chamber is at least equal to a length L2 of said second small-diameter portion, and, so that a distance L3 between said groove and the bottom end face of said plunger is larger than the amount of movement of said plunger corresponding to the amount of fuel supply for giving a maximum amount of injection;

a return path of which one end is connected to said groove and the other end is connected to a low-pressure portion having the same pressure as that of fuel supplied to said pressure chamber; and an orifice which is provided in said return path.

3. A fuel injector according to claim 1, wherein the oil pressure supplied to said upper cylinder is fuel having the same pressure as that of the fuel supplied to said pressure chamber.

4. A fuel injector according to claim 3 further including a spool valve which is controlled by an electromagnetic actuator, said spool valve switching between supply of fuel to said upper cylinder and supply of fuel to said pressure chamber.

5. A fuel injector according to claim 4, wherein said damper pressure control means comprise:

a groove which is formed in said lower cylinder and communicated through to said pressure chamber after said plunger moves to said prescribed position, said groove being formed between said transfer chamber and said pressure chamber so that a distance L1 between said groove and said transfer chamber is at least equal to a length L2 of said second small-diameter portion, and, so that a distance L3 between said groove and the bottom end face of said plunger is larger than the amount of movement of said plunger corresponding to the amount of fuel supply for giving a maximum amount of injection;

a return path of which one end is connected to said groove and the other end is connected to said spool valve, said spool valve giving fuel pressure supplied to said pressure chamber to said return path irrespective of switching of fuel supply between said cylinder and said pressure chamber; and an orifice which is provided in said return path.

6. A fuel injector according to claim 1, wherein said damper pressure control means comprise;

a vertical hole which is formed in said plunger and has one end is communicated through to said pressure chamber;

at least one control port which is formed in said plunger and communicates through to the other end of said vertical hole, said control port being maintained in a closed state by an inner wall of said lower cylinder until said pressure chamber is closed by said damper means, and said control port being communicated through to said cut-off chamber when said pressure chamber is closed; and a check valve provided in said vertical hole so that fuel may flow from said pressure chamber to said control port, said check valve having a valve opening pressure higher than the pressure of fuel supplied to said pressure chamber, and said check valve opening before the pressure of said pressure chamber becomes so much as to cause secondary fuel injection.

7. A fuel injector according to claim 1, wherein said damper pressure control means comprise;

a return path for communicating said pressure chamber to a low pressure portion, where the atmospheric pressure operates, when said pressure chamber is closed by said damper means;

an orifice which is provided in said return path; and an electromagnetic valve which is provided in said return path and closes said return path from start to end of supply of fuel to said pressure chamber, and opens said return path from start to end of movement of said plunger in said direction.

8. A fuel injector according to claim 4, wherein said damper pressure control means comprise;

a return path for communicating said pressure chamber to a low-pressure portion, where atmospheric pressure operates, when said pressure chamber is closed by said damper means;

an orifice which is provided in said return path; and an electromagnetic valve provided in said return path, which closes said return path when said spool valve supplies fuel to said pressure chamber, and opens said return path when said spool valve supplies fuel to said upper cylinder.

9. A fuel injector comprising;

an upper cylinder to which oil pressure is supplied;

a lower cylinder which provides a pressure chamber to which fuel is supplied, and located serially with said upper cylinder, a diameter being smaller than a diameter of said upper cylinder;

a piston which is provided in said upper cylinder to slide freely, and move in a direction to pressurize fuel supplied to said pressure chamber by receiving oil pressure supplied to said upper cylinder;

a plunger which is provided in said lower cylinder to slide freely, and is moved in said direction by said piston, said plunger pressurizing fuel supplied to said pressure chamber with a movement in said direction;

injection control means for supplying fuel pressurized by said plunger to a nozzle and for finishing supply of pressurized fuel to said nozzle with said plunger moved to a prescribed position, said injection control means having a cut-off chamber which is formed in said lower cylinder and communicated through to a low-pressure portion where atmospheric pressure operates, a transfer chamber which is formed in said lower cylinder and communicated through to said nozzle, a first small-diameter portion which is formed in said plunger and gives a first clearance between said plunger and said lower cylinder, said first clearance being communicated through to said cut-off chamber, a first pressurizing portion which is formed in said plunger, and its length in an axial direction being shorter than said transfer chamber, a second small-diameter portion which is formed in said plunger and gives a second clearance between said plunger and said lower cylinder, said second clearance being communicated through to said pressure chamber, said first pressurizing portion maintaining communication between said transfer chamber and said pressure chamber via said second clearance after said plunger starts movement in said direction until said plunger reaches said prescribed position, said first pressurizing portion, by movement of said plunger to said prescribed position, communicating said transfer chamber through to said cut-chamber via said first clearance, and, communicating said pressure chamber through to said second clearance, said transfer chamber and said first clearance to said cut-off chamber, and after said plunger moved to said prescribed position, said first pressurizing portion allowing communication between said pressure chamber and said cut-off chamber, without positively intercepting communication between said transfer chamber and said second clearance;

damper means which provides a damper piston, having a smaller diameter than said plunger and provided coaxially at an end of said plunger, and a damper chamber formed in concave shape in said pressure chamber for receiving said damper piston while allowing free sliding movement of said damper piston, said damper means damping the movement of said plunger by operating fuel pressure of said damper chamber to said damper piston; and damper pressure control means for bypassing fuel pressure of said damper chamber so that fuel pressure of said damper chamber does not become so much as to cause secondary fuel injection.

10. A fuel injector according to claim 9, wherein said damper pressure control means comprise;

a return path for communicating said damper chamber through to a low-pressure where atmospheric pressure operates; and an orifice which is provided in said return path.

11. A fuel injector according to claim 9, wherein said damper pressure control means is a slit which is formed in an inner wall of said damper chamber so that said pressure chamber and said damper chamber are communicated.

12. A fuel injector according to claim 9, wherein oil pressure supplied to said upper cylinder is fuel having the same pressure as that of fuel supplied to said pressure chamber.

13. A fuel injector according to claim 12 further including a spool valve which is controlled by an electromagnetic actuator, said spool valve switching between supply of fuel to said upper cylinder and supply of fuel to said pressure chamber.

14. A fuel injector according to claim 9, wherein fuel to said pressure chamber is supplied through said damper chamber.

* * * * *